US005311160A

United States Patent [19]

Higuchi et al.

[11] Patent Number: 5,311,160

[45] Date of Patent: May 10, 1994

[54] MECHANISM FOR ADJUSTING RESONANCE FREQUENCY OF DIELECTRIC RESONATOR

[75] Inventors: Yukio Higuchi; Hirotsugu Abe; Shigeyuki Mikami, all of Nagaokakyo, Japan

[73] Assignee: Murata Manufacturing Co., Ltd., Kyoto, Japan

[21] Appl. No.: 968,528

[22] Filed: Oct. 29, 1992

[30] Foreign Application Priority Data

Nov. 1, 1991 [JP] Japan ..... 3-090177[U]

[51] Int. Cl.[5] ..... H01P 7/10

[52] U.S. Cl. ..... 333/219.1; 333/235

[58] Field of Search ..... 333/202, 219, 219.1, 333/235, 222, 226; 331/96, 107 DP

[56] References Cited

U.S. PATENT DOCUMENTS 4,630,012 12/1986 Fuller et al. ..... 333/219.1 X
4,728,913 3/1988 Ishikawa et al. ..... 333/235
4,963,841 10/1990 Sparagna ..... 333/219.1 X
5,136,270 8/1992 Hatanaka et al. ..... 333/219.1

FOREIGN PATENT DOCUMENTS 58-155109 10/1983 Japan .
62-154802 7/1987 Japan .
0097603 3/1992 Japan ..... 333/219.1

*Primary Examiner*—Seungsook Ham
*Attorney, Agent, or Firm*—Armstrong, Westerman, Hattori, McLeland & Naughton

[57] ABSTRACT

A mechanism for adjusting the resonance frequency of a dielectric resonator having $TE_{01\delta}$ mode as its operation mode under the presence of the electromagnetic field including: a hole extending along the axis of the dielectric resonator; a tuning bar, made of a dielectric material of a low loss, having a male screw formed on the peripheral surface thereof; and a female screw, to engage the male screw, formed on the wall of the hole. The tuning bar is reciprocated in the hole with the tuning bar engaging the hole so as to adjust the resonance frequency.

8 Claims, 3 Drawing Sheets

MECHANISM FOR ADJUSTING RESONANCE FREQUENCY OF DIELECTRIC RESONATOR

BACKGROUND OF THE INVENTION

1. Field of the Invention

The present invention relates to a mechanism for adjusting the resonance frequency of a dielectric resonator having $TE_{01\delta}$ mode under the presence of electromagnetic field.

2. Description of the Related Arts

In recent years, dielectric resonators which oscillates in $TE_{01\delta}$ mode are used in the local oscillator of a down-converter for converting a radio wave signal, transmitted from a satellite and received by an antenna, into a signal of a low frequency. An example of a conventional dielectric resonator of this kind is shown in FIG. 3.

The dielectric resonator 1 is cylindrical and made of a dielectric material having a high dielectric constant. The dielectric resonator 1 is adhered with resin or glass to a support 2 made of ceramic having a low dielectric constant. The dielectric resonator 1 and the support 2 are accommodated in a metal case 3 accommodating the local oscillator of the down-converter of a satellite broadcasting receiver not shown.

In addition to the function of supporting the dielectric resonator 1, the support 2 resonates the dielectric resonator 1 in $TE_{01\delta}$ mode in the metal case 3 and adjusts the coupling between the dielectric resonator 1 and circuits (not shown) composing the oscillator of the down-converter.

The resonance frequency $f_0$ of the dielectric resonator 1 is determined by parameters such as the relative dielectric constant ($\epsilon_r$) of a dielectric material composing the dielectric resonator 1, the dimension thereof, the supporting position of the dielectric resonator 1 in the metal case 3, and the inner dimension of the metal case 3.

However, the parameters have deviations in manufacturing the oscillator of the down-converter for the satellite broadcasting receiver, and consequently, the resonance frequency $f_0$ of the dielectric resonator 1 also has deviations.

The dielectric resonator 1 has the following construction for adjusting the resonance frequency $f_0$ so that the resonance frequency $f_0$ has a predetermined value.

That is, a through hole 4 is formed in the upper wall of the metal case 3 in opposition to the upper surface of the dielectric resonator 1 and a metal tuning screw 5 is inserted into the hole 4 as shown in FIG. 3. The resonance frequency $f_0$ is adjusted to have a uniform value by changing the insertion amount (d) of the tuning screw 5 into the hole 4.

The conventional mechanism for adjusting the resonance frequency of the dielectric resonator has a problem that when the interval between the tuning screw 5 and the dielectric resonator 1 becomes small in inserting the tuning screw 5 toward the dielectric resonator 1, the tuning screw 5 approaches a region in which the intensity of the electric field enclosed in the dielectric resonator 1 and in the vicinity thereof in the metal case 3 is great. As a result, conductor loss increases and thus the unloaded Q(Qu) of the dielectric resonator 1 drops.

SUMMARY OF THE INVENTION

It is an object of the present invention to provide mechanism for easily adjusting the resonance frequency of a dielectric resonator which changes unloaded Q in a small extent in adjusting resonance frequency and resonance frequency linearly with the position change of a tuning bar.

In accomplishing these and other objects of the present invention, there is provided a mechanism for adjusting the resonance frequency of a dielectric resonator having $TE_{01\delta}$ mode as its operation mode under the presence of an electromagnetic field comprising, a hole extending along the axis of the dielectric resonator, a tuning bar, made of a dielectric material with low loss, having a male screw formed on the peripheral surface thereof and a female screw, to engage the male screw, formed on the wall of the hole, wherein the tuning bar is reciprocated in the hole with the tuning bar engaging the hole.

According to the above construction, since the tuning bar is made of a dielectric material with low loss and provided inside the dielectric resonator enclosing the electromagnetic field and the strong electric field, energy loss is small even though the tuning bar moves inside the dielectric resonator. Thus, the unloaded Q of the dielectric resonator can be prevented from lowering and resonance frequency of the dielectric resonator linearly changes with the position change of the tuning bar. Thus, an oscillator which allows resonance frequency to be adjusted accurately and easily can be obtained by incorporating the mechanism according to the present invention in the down-converter of a receiving antenna for use in satellite broadcasting or satellite communication.

Further, the tuning bar and the dielectric resonator compose the mechanism for adjusting the resonance frequency. Therefore, in incorporating the mechanism in the down-converter of the receiving antenna, it is unnecessary to change the designing of a die for manufacturing a metal case for accommodating the dielectric resonator even though the fixing position of the dielectric resonator is changed due to the design change of a circuit pattern to be connected with the dielectric resonator.

BRIEF DESCRIPTION OF THE DRAWINGS

These and other objects and features of the present invention will become clear from the following description taken in conjunction with the preferred embodiments thereof with reference to the accompanying drawings, in which.

DETAILED DESCRIPTION OF THE INVENTION

Figure 1:
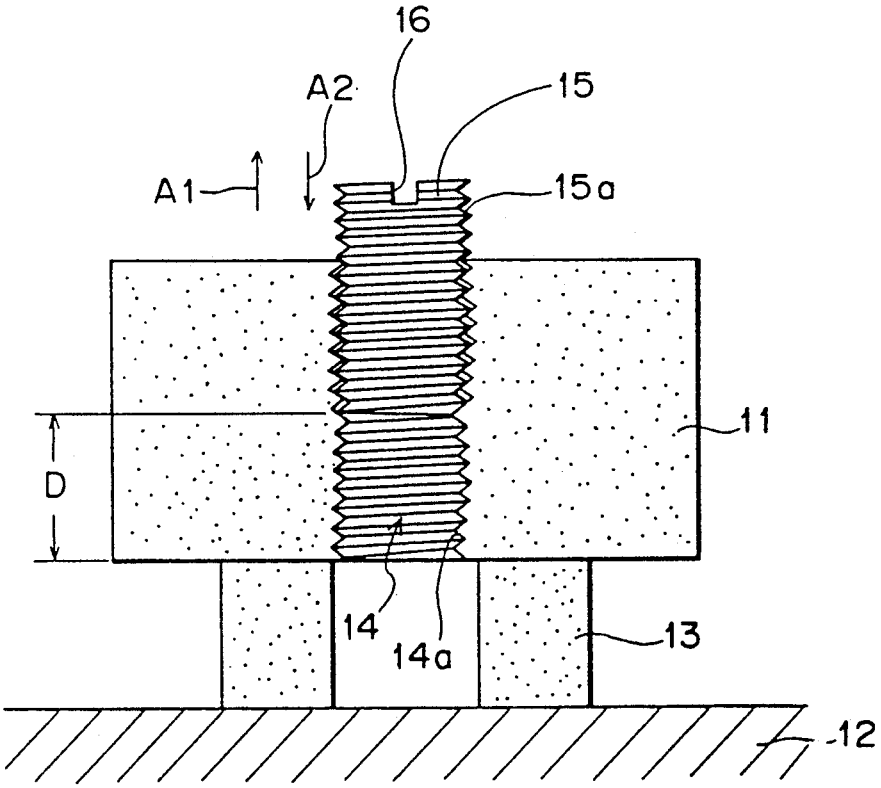
FIG. 1 is a longitudinal sectional view showing a mechanism for adjusting the resonance frequency of a dielectric resonator according to an embodiment of the present invention.

Before the description of the present invention proceeds, it is to be noted that like parts are designated by like reference numerals throughout the accompanying drawings.

The embodiment of the present invention will be described below with reference to the drawings. FIG. 1 shows a mechanism for easily adjusting the resonance frequency of a dielectric resonator according to the present invention.

A dielectric resonator 11 which is cylindrical is made of a dielectric material having a great dielectric constant. The dielectric resonator 11 has $TE_{01\delta}$ mode as its operation mode under the existence of an electromagnetic field. The dielectric resonator 11 is supported by a metal case accommodating it on a support 13 fixed to a flat electric conductor 12 such as the electric conductor pattern of a circuit substrate.

The support 13 made of ceramic having a low dielectric constant is adhered to the dielectric resonator 11 with resin or glass. The support 13 fixed to the electric conductor 12 resonates the dielectric resonator 11 in $TE_{01\delta}$ mode and adjusts the coupling between the dielectric resonator 11 and the circuits.

The dielectric resonator 11 comprises a hole 14 extending along the axis thereof; a tuning bar 15, made of dielectric material having a low loss, having a male screw 15*a* formed on the peripheral surface thereof; and a female screw 14*a* formed on the wall of the hole 14.

The resonance frequency $f_0$ of the dielectric resonator 11 is adjusted by screwing the tuning bar 15 into the hole 14, with the blade of an adjusting driver not shown inserted into a groove 16 formed on the tuning bar 15 as shown by arrows A1 and A2.

Figure 2:
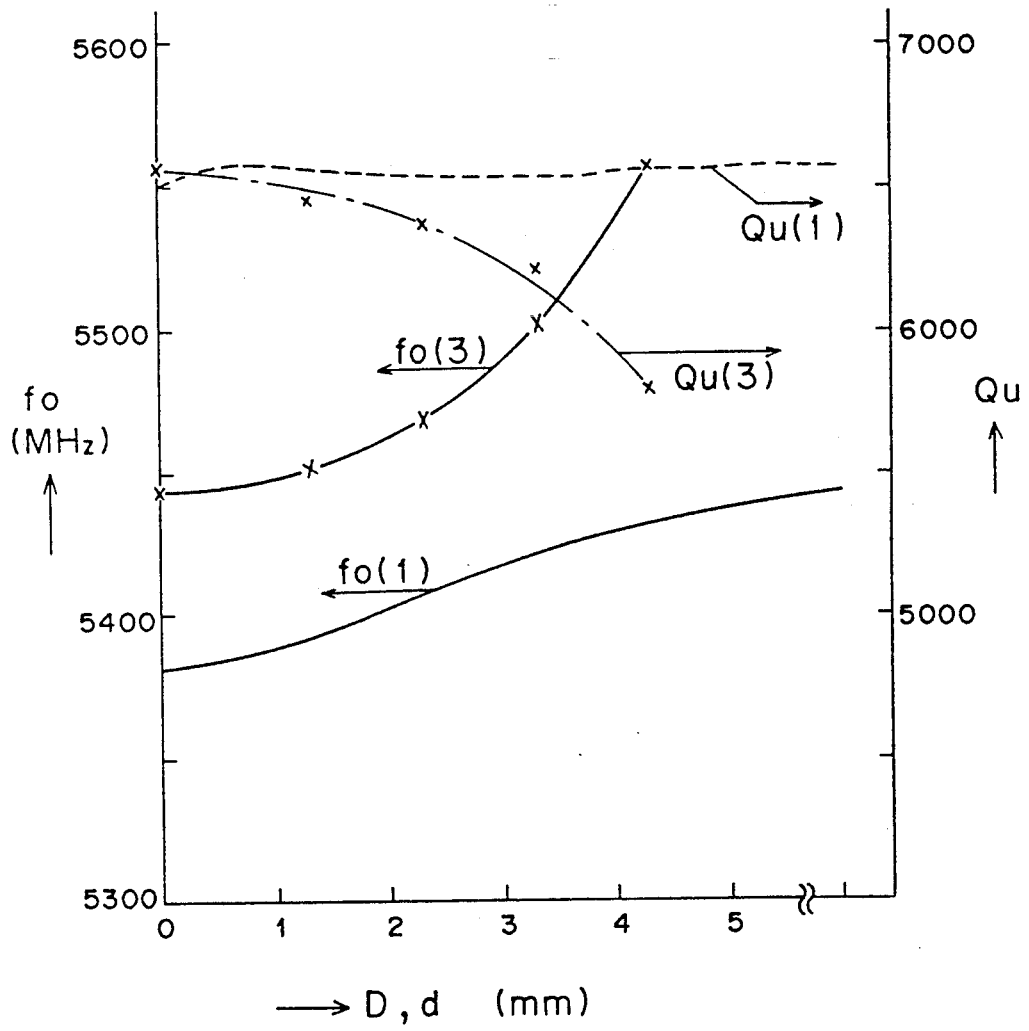
FIG. 2 is a graph showing the change in the resonance frequency and unloaded Q of the mechanism of FIG. 1 and a conventional mechanism measured by varying the position of a tuning bar and that of a tuning screw, respectively.
Figure 3:
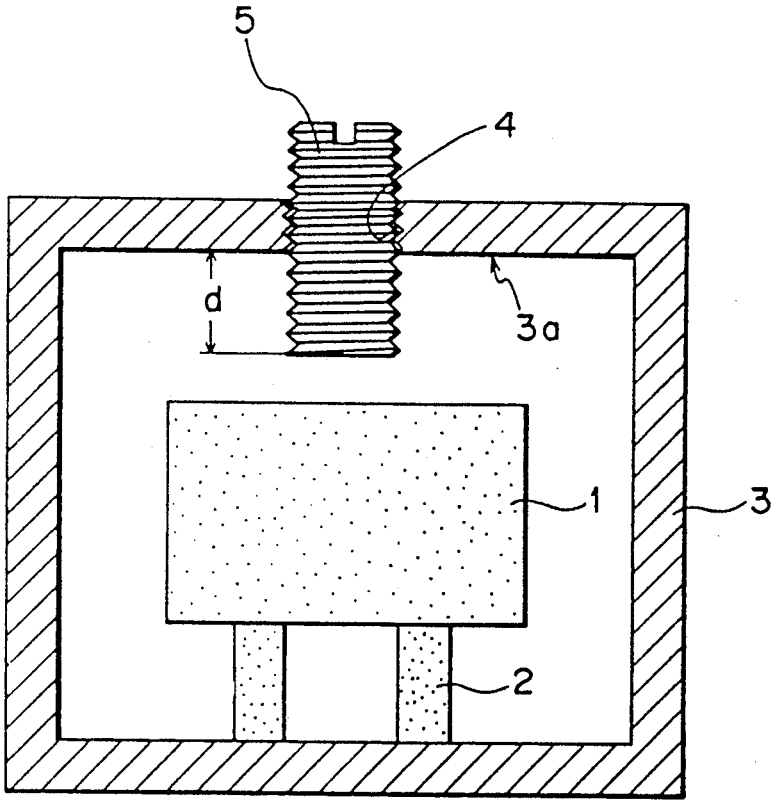
Fig. 3 PRIOR ART
FIG. 3 is a longitudinal sectional view showing a conventional mechanism for adjusting the resonance frequency of a dielectric resonator.

FIG. 2 shows the change in the resonance frequency $f_0$ and unloaded Q(Qu) of the dielectric resonator 11 as shown in FIG. 1 and those of the conventional dielectric resonator 1 as shown in FIG. 3 measured by the position change of the tuning bar 15 and that of the tuning screw 5, respectively.

Referring to FIG. 2, a curve $f_0$(1) and Qu(1) show the change in the resonance frequency $f_0$ and that in the unloaded Q(Qu) measured when the distance D (mm) between the bottom of the dielectric resonator 11 and the bottom of the tuning bar 15 is varied.

Referring also to FIG. 2, a curve $F_0$(3) and Qu(3) show the change in the resonance frequency $f_0$ and that in the unloaded Q(Qu) when the distance d (mm) between the inner upper surface 3*a* of the metal case 3 as shown in FIG. 3 and the bottom of the tuning screw 5 is changed.

As shown in FIG. 2, compared with the mechanism comprising the dielectric resonator 11 as shown in FIG. 1, the adjusting range of the resonance frequency $f_0$ of the conventional dielectric resonator 1 is wide but the unloaded Q(Qu) drops outstandingly with the increase of the resonance frequency $F_0$. More specifically, in the case of the dielectric resonator 1, the rate of change ($\Delta Qu/Q_u$) of the unloaded Q is approximately 3% when the rate of change ($\Delta f/F_0$) of the center frequency is 0.45%.

In the case of the dielectric resonator 11, the unloaded Q changes in a slight extent with the change of the resonance frequency $F_0$. More specifically, in the case of the dielectric resonator 11, the rate of change ($\Delta Qu/Q_u$) of the unloaded Q is approximately 0.9% when the rate of change ($\Delta f/F_0$) in the center frequency is 0.40%. The change in the resonance frequency $f_0$ is expressed in a linear figure compared with that of the dielectric resonator 1. Thus, in the dielectric resonator 11, the resonance frequency $f_0$ can be easily adjusted.

Although the present invention has been fully described in connection with the preferred embodiments thereof with reference to the accompanying drawings, it is to be noted that various changes and modifications are apparent to those skilled in the art. Such changes and modifications are to be understood as included within the scope of the present invention as defined by the appended claims unless they depart therefrom.

What is claimed is:

1. A mechanism for adjusting the resonance frequency of a dielectric resonator comprising:

a dielectric resonator body having an axis wherein said dielectric resonator body having a $TE_{01}$ mode as its operation mode under the presence of an electromagnetic field a hole extending along said axis of said dielectric resonator, said hole being bounded by an internal wall of said dielectric resonator body;

a tuning bar having a peripheral surface, said tuning bar being composed entirely of dielectric material of a low loss, having a male screw thread formed on said peripheral surface; and a female screw thread, to engage the male screw thread, formed on said internal wall bounding said hole, wherein said tuning bar is movably supported for axial movement within said hole by engagement of said male screw thread with said female screw thread.

2. The mechanism as defined in claim 1, wherein said dielectric resonator body and said tuning bar together have a rate of change of an unloaded Q at approximately 3.0 to 0.9% when a rate of change of a center frequency thereof is 0.45 to 0.40%.

3. A dielectric resonator having an adjustable resonance frequency, comprising:

a dielectric body having an axis, wherein said dielectric resonator body having a $TE_{01}$ mode as its operation mode under the presence of an electromagnetic field;

a hole extending completely through said dielectric body along said axis of said dielectric body, said hole being bounded by an internal wall of said dielectric body, said internal wall having a first screw thread thereon;

a tuning bar having a peripheral surface, said tuning bar being composed entirely of dielectric material, said tuning bar having a second screw thread formed on said peripheral surface, said second screw thread mating with said first screw thread of said internal wall of said dielectric body;

wherein said tuning bar is movably supported for axial movement within said hole by engagement of said first screw thread with said second screw thread, such that rotation of said tuning bar relative to said dielectric body caused axial movement within said hole.

4. A dielectric resonator as defined in claim 3, wherein said dielectric body and said tuning bar together are configured so as to have a rate of change ($\Delta Qu/Qu$) of unloaded Q at approximately 3.0 to 0.9% when a rate of change ($\Delta f/f_0$) of the center frequency is 0.45 to 0.40%.

5. A dielectric resonator as defined in claim 3, wherein said hole extends completely through said dielectric body and has threading along its entire length.

6. A dielectric resonator having an adjustable resonance frequency comprising:

a dielectric body having an axis, wherein said dielectric resonator body having a $TE_{01}$ mode as its operation mode under the presence of an electrogmagnetic field;

a hole extending completely through said dielectric body along said axis of said dielectric body, said hole being bounded by an internal wall of said dielectric body, said internal wall having a first screw thread composed entirely of dielectric material thereon;

a tuning bar having a peripheral surface, said tuning bar being composed entirely of dielectric material, said tuning bar having a second screw thread composed entirely of dielectric material formed on said peripheral surface, said second screw thread mating with said first screw thread of said internal wall of said dielectric body;

said second screw thread composed entirely of said dielectric material being in direct contact with said first screw thread formed entirely of said dielectric material;

wherein said tuning bar is movably supported for axial movement within said hole by engagement of said first screw thread with said second screw thread, such that rotation of said tuning bar relative to said dielectric body caused axial movement within said hole.

7. A dielectric resonator as defined in claim 6, wherein said dielectric body and said tuning bar together are configured so as to have a rate of change ($\Delta Qu/Qu$) of unloaded Q at approximately 3.0 to 0.9% when a rate of change ($\Delta f/f_0$) of the center frequency is 0.45 to 0.40%.

8. A dielectric resonator as defined in claim 6, wherein said hole extends completely through said dielectric body and has said first screw thread along its entire length.

* * * * *